US009776753B2

(12) United States Patent
Baltes

(10) Patent No.: US 9,776,753 B2
(45) Date of Patent: Oct. 3, 2017

(54) METHOD AND DEVICE FOR CONVEYING PIECE GOODS IN A FILLING MACHINE

(71) Applicant: ELOPAK AS, Spikkestad (NO)

(72) Inventor: Klaus Baltes, Bergheim (DE)

(73) Assignee: ELOPAK AS, Spikkestad (NO)

( * ) Notice: Subject to any disclaimer, the term of this patent is extended or adjusted under 35 U.S.C. 154(b) by 0 days.

(21) Appl. No.: 14/653,689

(22) PCT Filed: Dec. 17, 2013

(86) PCT No.: PCT/EP2013/076994
§ 371 (c)(1),
(2) Date: Jun. 18, 2015

(87) PCT Pub. No.: WO2014/095934
PCT Pub. Date: Jun. 26, 2014

(65) Prior Publication Data

US 2016/0001905 A1 Jan. 7, 2016

(30) Foreign Application Priority Data

Dec. 20, 2012 (DE) ..... 10 2012 112 792

(51) Int. Cl.
*B65B 43/56* (2006.01)
*B65B 43/48* (2006.01)
(Continued)

(52) U.S. Cl.
CPC ..... *B65B 43/56* (2013.01); *B65B 3/025* (2013.01); *B65B 43/48* (2013.01); *B65B 43/50* (2013.01);
(Continued)

(58) Field of Classification Search
None
See application file for complete search history.

(56) References Cited

U.S. PATENT DOCUMENTS 3,486,423 A 12/1969 Mistarz
4,548,244 A 10/1985 Risko
(Continued)

FOREIGN PATENT DOCUMENTS

DE 4142167 C2 6/1993
EP 0079561 A1 5/1983
RU 2561924 A 12/2014

OTHER PUBLICATIONS

English translation of International Preliminary Report on Patentability, dated Jun. 23, 2015, 2 pages.
(Continued)

*Primary Examiner* — Kavel Singh
(74) *Attorney, Agent, or Firm* — Lucas & Mercanti, LLP

(57) ABSTRACT

The invention relates to a method for the clocked conveying of packaging containers in a filling machine for flowable products along a conveying line with a first and a second section, a first conveying means and a second conveying means being operated at different clock cycles in the first section of the conveying line and in the second section of the conveying line respectively, and a handling device arranged between the first and the second sections of the conveying line compensating for the different clock times between the first and second conveying means. The clock time for filling flowable products into the packaging containers can thus be sufficiently measured in the second section of the conveying line, without having to accept unnecessary dead time for performing a processing step in the first section of the conveying line. Further disclosed is a device for performing the method.

20 Claims, 7 Drawing Sheets

(51) Int. Cl.

| | |
|---|---|
| ***B65B 43/50*** | (2006.01) |
| ***B65B 43/52*** | (2006.01) |
| ***B65B 3/02*** | (2006.01) |

(52) U.S. Cl.
CPC ..... *B65B 43/52* (2013.01); *B31B 2203/082* (2013.01)

(56) References Cited

U.S. PATENT DOCUMENTS

| | | | | |
|---|---|---|---|---|
| 4,566,251 | A * | 1/1986 | Spisak | B65B 55/10 53/167 |
| 4,588,391 | A | 5/1986 | Evans | |
| 6,032,343 | A * | 3/2000 | Blanch | A61B 17/06 29/33 R |
| 7,278,531 | B2 * | 10/2007 | Hartness | B65G 17/385 198/470.1 |
| 9,522,751 | B2 | 12/2016 | Baltes | |
| 2008/0010954 | A1 | 1/2008 | Maria | |

OTHER PUBLICATIONS

English translation of Written Opinion of the International Searching Authority, 3 pages.

* cited by examiner

METHOD AND DEVICE FOR CONVEYING PIECE GOODS IN A FILLING MACHINE

CROSS-REFERENCE TO RELATED APPLICATIONS

This application is a 371 of PCT/EP2013/076994 filed Dec. 17, 2013, which in turn claims the priority of DE 10 2012 112 792.1 filed Dec. 20, 2012, the priority of both applications is hereby claimed and both applications are incorporated herein by reference.

BACKGROUND OF THE INVENTION

The invention pertains to a method for the timed, stepwise conveyance of piece goods in a filling machine for liquid products along a conveying line with a first and a second section, comprising the steps of

- conveying the piece goods in the first section by means of a first conveying means and conveying the piece goods in the second section by means of a second conveying means;
- unloading the piece goods from the first conveying means and loading the second conveying means with the piece goods.

The invention also pertains to a device for the timed, stepwise conveyance of piece goods in a filling machine for liquid products along at least one conveying line with a first and a second section, comprising a first conveying means with a timed, stepwise drive for conveying the piece goods in the first section and a second conveying means with a timed, stepwise drive for conveying the piece goods in the second section.

Filling machines for filling packaging containers consisting of composite cardboard material with liquid products, especially liquid food products, are known from the prior art. Concerning the design of such a filling machine, reference can be made by way of example to DE 41 42 167 C2.

In a filling machine, a folded package jacket is picked up in a first section of a conveying line by a first conveying means. The first conveying means is usually configured as a mandrel wheel, rotating in stepwise fashion, which comprises several radially outward-projecting mandrels, which engage in the unfolded package jackets. While the mandrel wheel is in the idle interval of its timing step, an operation is carried out at the free ends of the package jackets. In particular, folding and pressing tools are used to produce the bottom of the package, so that a half-open packaging container is formed from the package jacket. As soon as the mandrel carrying the half-open packaging container is pointing vertically downward, the packaging container is unloaded from the mandrel wheel with the help of a stripper; the container then slides into a cell, oriented to align with the mandrel, of a second conveying means, in particular a conveying means configured as a link-belt conveyor. The packaging container, which is open at the top, stands upright in the cell and is conveyed through a sterile space, for example, of the filling machine, in which a filling station for the liquid products is located. While the second conveying means is in an idle interval of its timing step, another operation is carried out such as, in particular, the filling of the packaging container.

The first and second conveying means are operated with the same timing. The speed of the stepwise movement is based on the most time-consuming work operation to be performed on the conveying line. In the case of the known filling machines, this is the introduction of the liquid product into the packaging container. During this filling operation, the stepwise movement must be slow enough to prevent foam from forming and/or from the acceleration to become too great, since that could cause product which has been introduced into the packaging container to slosh about. In no case may any foam or liquid product spill onto the inside surfaces of the upper edge of the packaging container, because these areas must be kept liquid-free for the sake of the next work step, in which the top of the package is formed; otherwise, a satisfactory seal, produced by the application of heat and pressure, cannot be achieved.

The time required to fill a package exceeds the time required to produce the bottom of a package.

Because the half-open packaging container must be transferred from the mandrel wheel to the link-belt conveyor, however, the timing of the mandrel wheel and of the link-belt conveyor must agree. This means that, with respect to the goal of ensuring the greatest possible throughput of the filling machine, the time between the stepwise movements of the mandrel wheel is too long, and the time between the stepwise movements of the link-belt conveyor is at the lower limit of the technically feasible time window.

BRIEF SUMMARY OF THE INVENTION

Against the background of this prior art, an object of the invention is to provide a method in which the time between the stepwise movements for critical processing operations in a second section of the conveying line, especially for the introduction of liquid products into the packaging containers, is sufficiently long but not so long that unnecessary dead times in the performance of a processing operation in the first section of the conveying line must be accepted. In addition, a device for carrying out the method is also to be described.

The object is achieved by operating the first conveying means in the first section of the conveying line with one timing and the second conveying means in the second section of the conveying line with a different timing, wherein a handling device arranged between the first and the second sections of the conveying line compensates for the difference between the timing of the movements of the first and second conveying means.

In one embodiment, the method of the invention includes:

- operating the first conveying means with a first timing, each step of which comprises an idle interval and a conveying interval;
- operating the second conveying means with a timing different from the first timing, each step of which comprises an idle interval and a conveying interval, wherein each idle interval of the second timing overlaps in time at least two idle intervals of the first timing;
- unloading one of the piece goods from the first conveying means during each idle interval of the first timing by means of a handling device arranged between the first and the second sections of the conveying line; and
- loading, by means of the handling device, the second conveying means during an idle interval of the second timing with all of the piece goods unloaded from the first conveying means during this idle interval.

The timing of the second conveying means is determined in such a way that each idle interval of the second timing overlaps timewise with at least two idle intervals of the first timing. As a result, it is possible, during an idle interval of the first timing, to unload at least two packaging containers from the first conveying means, which are then available for the performance of the parallel processing operation, in particular the simultaneous filling of the two packaging containers during an idle interval of the second timing in the second section of the conveying line. The duration of a step of the second timing is preferably a whole-number multiple of the duration of a step of the first timing. As a result, the idle and conveying intervals of the first and second conveying means can be easily synchronized.

For the filling of the packaging containers, it is advantageous for the loading of the second conveying means with the piece goods, in particular with the half-open packaging containers, to take place at several set-down positions arranged with a certain offset from each other in the direction of the conveying line. The packaging containers are then already arranged on the second conveying means in a way which is adapted to the automated filling of the half-open packaging containers.

To ensure short transport distances for the piece goods and a high unloading and loading speed for the handling device, each piece is unloaded from the first conveying means into an unloading position, which is located between two set-down positions on the second conveying means. After it has been unloaded from the first conveying means and before it is loaded onto the second conveying means, each piece is transported from this unloading position to one of the set-down positions.

According to the invention, it is advantageous for both the first and the second section of the conveying line, the set-down positions on the second conveying means, and the unloading position located between two set-down positions to all be situated in a common vertical plane. As a result, the floor space required for the conveying operations and therefore the necessary set-up area for a filling machine with a device for the timed, stepwise conveyance of piece goods can be kept as small as possible. In contrast, conveyors with conveying lines with parts extending in horizontal planes and parts extending in vertical planes demand much larger amounts of floor space and set-up areas. In particular, it is a practical impossibility to realize a filling machine with several conveying lines extending only in horizontal planes.

In that each piece, after it has been unloaded from the first conveying means and before it is loaded onto the second conveying means, is rotated around a longitudinal axis of the piece, the piece can be oriented in the handling device in a manner suitable for the following processing operations. Especially for the formation of the top of a packaging container, it is advantageous for the gable flaps of the package top which are to be welded together to be oriented in the direction of the conveying line. The welding cheeks required to do the welding are arranged parallel to the conveying line and thus do not interfere with the transport of the packaging containers. So that the handling device can carry out the unloading and loading operations at high speed, each piece is preferably rotated as it is being transported from the unloading position to one of the set-down positions.

To increase the throughput of the filling machine, the piece goods are conveyed in timed steps through the filling machine along several parallel conveying lines, wherein the arrangement and timing of the first and second conveying means and the arrangement of each handling device are the same in all of the conveying lines. Because of the parallel arrangement and parallel timing, the drives of the first and second conveying means can be combined. For example, several transport wheels can be mounted on a single shaft and rotated by a single drive. In similar fashion, the holders of every second conveying means, which holders are arranged next to each other in a row in the direction of the conveying line, can be arranged on a common link belt of a link-belt conveyor. A single handling device can be arranged between the first and second sections of the parallel conveying lines to unload and to load the piece goods. Alternatively, a handling device can be assigned to only a subset of the parallel conveying lines.

A preferred handling device between the first and second sections of the conveying line comprises means for unloading the piece goods from the first conveying means into an unloading position, means for transporting the piece goods from the unloading position to the set-down positions, and means for loading the second conveying means with the piece goods at the set-down positions. The unloading position is located a certain distance away from the set-down positions for the piece goods on the second conveying means, these positions being arranged with an offset from each other in the direction of the conveying line. To keep the transport distances to the set-down positions short, the unloading position is preferably located between two of the set-down positions offset from each other in the direction of the conveying line.

Insofar as the first conveying means comprises a transport wheel comprising several radially outward-projecting, parallel holding fixtures, each of which accommodates one of the pieces, the means for unloading the handling device is preferably configured as a stripper, which can be brought up to rest against one edge and/or surface of the piece. By means of the stripper, the half-open packaging container can be pushed from the radial holding fixture into an unloading position.

Insofar as the second conveying means comprises an endless link-belt conveyor, which comprises holders arranged next to each other in the direction of the conveying line, each holder accommodating one of the piece goods, preferably at least two pusher elements are provided as loading means, each of which can be brought into contact with one edge and/or surface of the piece. The pusher elements are preferably oriented in such a way that, after one of the piece goods has been transported from the unloading position to a set-down position, one of the pushers can push the piece into the holder on the link-belt conveyor located in the associated set-down position.

So that it is possible both to unload one of the piece goods from the first conveying means and to load the second conveying means with at least two piece goods with only one stroke, both the means for unloading the handling device and the means for loading it are preferably mounted on a single-axis positioning system.

The transverse transport of the piece goods from the unloading position to the set-down positions is preferably accomplished by means of a linear slide, which is free to move from the unloading position to the set-down positions, and on which at least two holders, arranged with an offset to each other in the direction of the conveying line, are arranged to hold the piece goods. In particular, the holders encompass the outer edges of the half-open packaging containers in such a way that the packaging containers can be pushed vertically into the holder by the stripper and pushed vertically out of the holders by the pusher elements.

The movement of the linear slide in the horizontal direction can bring each of the holders on the linear slide, as desired, either into the unloading position or into alignment with one of the set-down positions. In the unloading position, the stripper can unload the packaging container from the downward-pointing holding fixture of the stationary transport wheel into whichever one of the two holders is located in the unloading position. By means of the subsequent transverse movement of the holders by means of the movable linear slide to one of the set-down positions, the holder holding one of the packaging containers can be brought into alignment with one of the set-down positions, so that the second, idle conveying means can be loaded. For this purpose, the associated pusher element of the handling device moves vertically downward and thus pushes the package jacket vertically out of the holder into one of the holders of the link-belt conveyor, namely, the holder located in the set-down position in question.

Insofar as the holders for holding the piece goods are supported rotatably on the linear slide, the movement of the linear slide and the rotation of the holders can be linked to each other by connecting each holder to the stand of the handling device or to the machine stand by means of a coupling linkage, which causes the holders to rotate when the linear slide is moved.

The method and the device according to the invention for cycled conveyance is explained in greater detail below.

DETAILED DESCRIPTION OF THE PREFERRED EMBODIMENTS

Figure 1A:
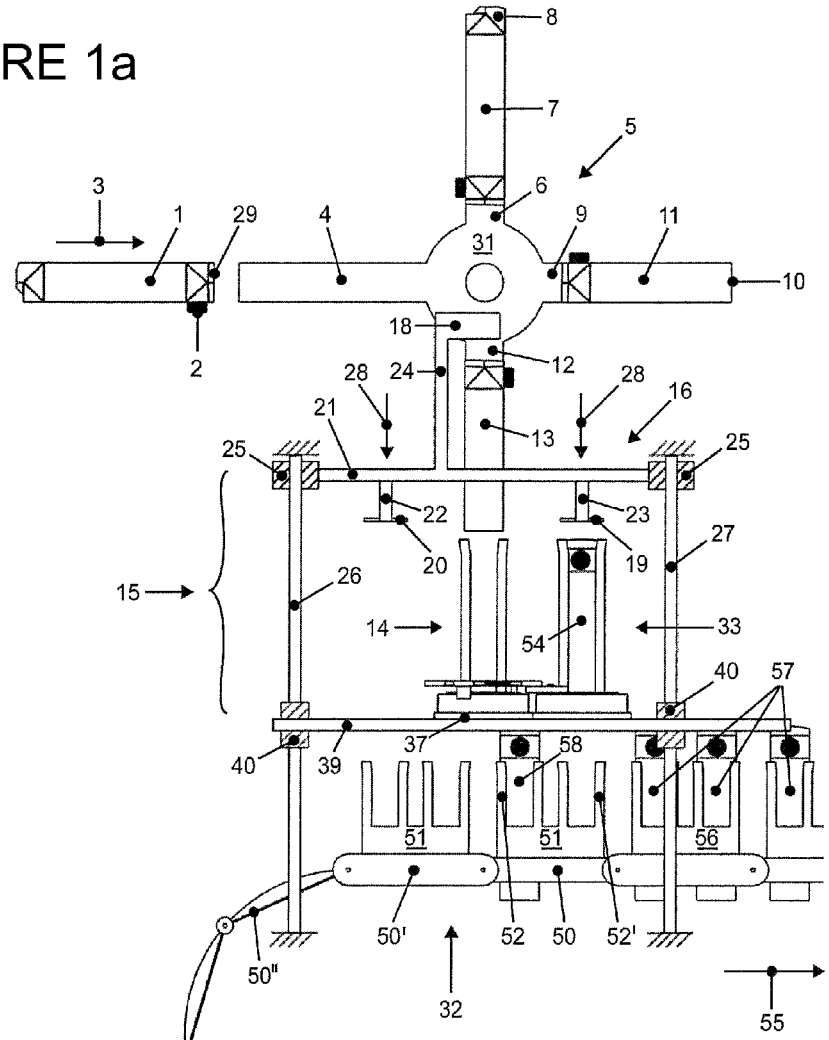
FIG. 1*a* is an elevation view of a device for conveying goods with a handling device located between a first conveyor and a second conveyor in a first step of a method according to an embodiment of the present invention.

FIG. 1*a* shows an upright package jacket 1, which has already been provided with a resealable opening aid 2. The package jacket 1 for the production of a packaging container is pushed in the direction of the arrow 3 onto a radially outward-projecting holding fixture 4 of a first conveying means in the form of a transport wheel 5. On a second holding fixture 6, adjacent in the clockwise direction, is a package jacket 7; the bottom of the package is formed from the free end 8 of the jacket projecting beyond the holding fixture 6. On the third holding fixture 9 is a packaging container 11 with a closed bottom 10. On the fourth holding fixture 12, pointing vertically downward, is a packaging container 13 in an upright position ready to be unloaded from the transport wheel 5 into a first holder 14 of a handling device 15. The handling device 15 is arranged between a first section of a conveying line 46, 47 extending around the transport wheel 5 and a second section of the conveying line 46, 47 extending along a second conveying means in the form of a link-belt conveyor 32.

A single-axis positioning system 16 of the handling device 15 comprises a transverse rod 21, the two ends of which are mounted in bushings 25, so that rod can move downwards along perpendicular guide rods 26, 27, in the direction of the arrow 28, and also upwards in the direction of the arrow 30 (see FIG. 2*a*) back to the starting position. A stripper 18 projects vertically upward from the transverse rod 21. To the left and right of the stripper 18, there is in each case a pusher element 19, 20, which extends vertically downward from the transverse rod 21. The stripper 18 serves the purpose of stripping the packaging container 13 from the downward-pointing holding fixture 12 and into the holder 14, 33, which is located in an unloading position. The stripper 18 rests continuously and elastically on the sides of the holding fixture 4, 6, 9, 12 in question, so that the packaging container located in the lower position of the transport wheel 5 can be reliably gripped at its upper package edge 29 and stripped off. To ensure that the stripper 18 makes satisfactory contact, the sides of the holding fixtures 4, 6, 9, 12 and the center part 31 of the transport wheel 5 form a continuous contact surface.

The handling device 15 also comprises a linear slide 37, configured as a linear table, to transport the packaging containers from the unloading position to the two set-down positions, which are located on the second conveying means, i.e., on the link-belt conveyor 32, underneath the pusher elements 19, 20. The linear slide 37 is moved back and forth in the direction of the link-belt conveyor 32 by means of a drive (not shown) acting on two horizontal guide rods 38, 39, which slide in bushings 40. Arranged on the linear slide 37 is the first holder 14 and a second holder 33, offset in the direction of the conveying line 46, 47, for the packaging containers, each holder comprising four angle brackets 34 for gripping the package edges of the packaging containers. Each of the holders 14, 33 is mounted, with freedom to rotate 90° back and forth, on a rotary table 35, 36, 35', 36' (see FIG. 1*b*) on the linear slide 37.

Figure 1B:
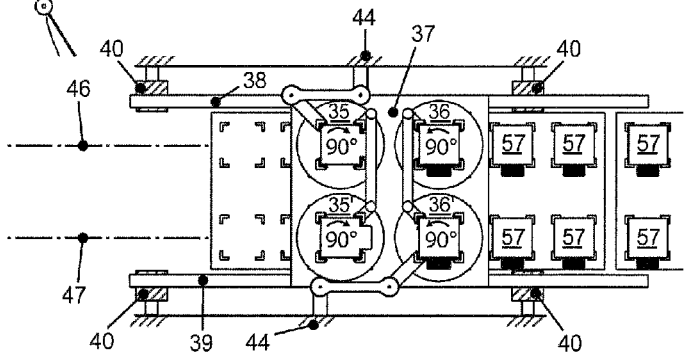
FIG. 1*b* is a plan view of the handling device and the second conveying device of the device of FIG. 1*a*.
Figure 1C:
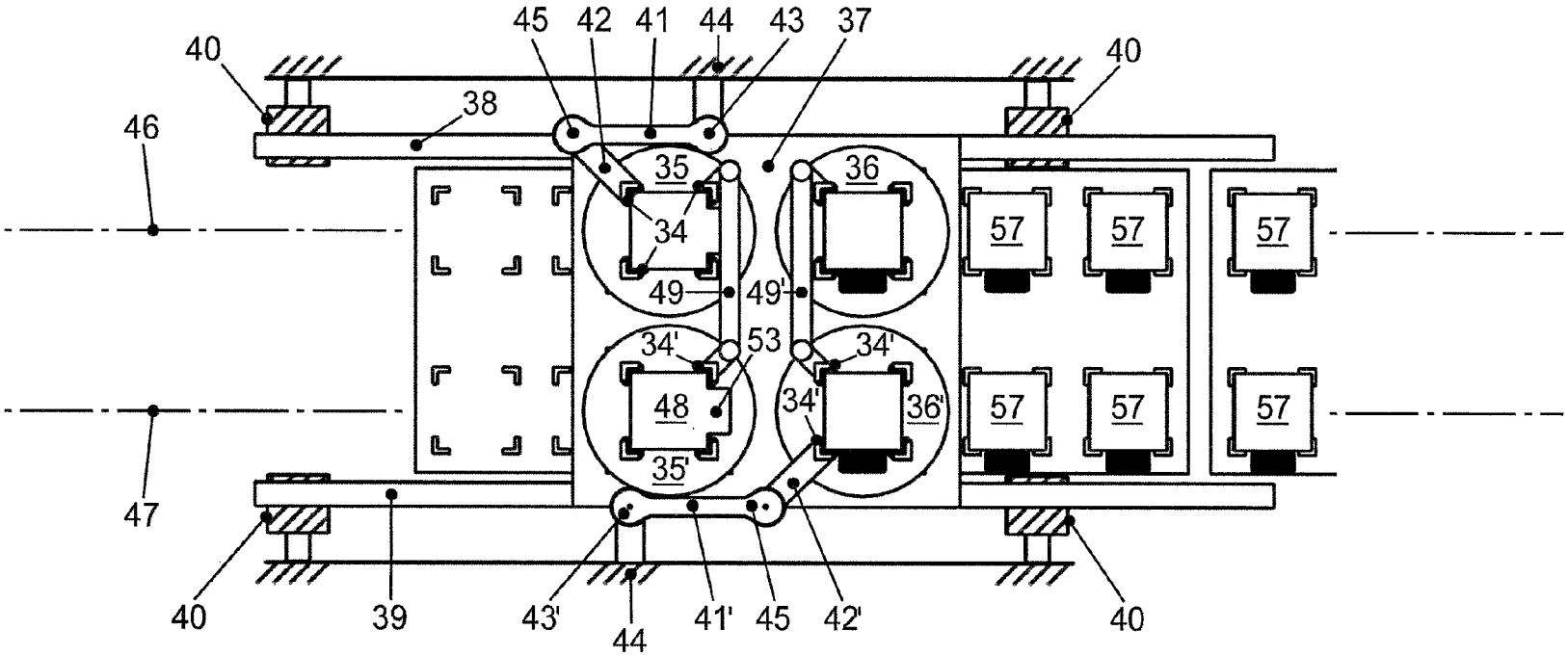
FIG. 1*c* is a detailed plan view of the handling device and the second conveying device of FIG. 1*b;*

FIG. 1*b*, an enlarged version of which appears in FIG. 1*c*, shows a top view of the handling device 15, from which it can be seen that the illustrated device comprises two parallel conveying lines 46, 47, wherein the arrangement and timing of the first and second conveying means in the two conveying lines 46, 47 are the same. The first conveying means, i.e., the two transport wheels 5, one for each first section of each conveying line 46, 47, are arranged on a common drive shaft. As a result, the complexity of the drive and the amount of space it occupies are reduced, and the synchronous operation of the two first conveying means is ensured. Of course, it is also within the scope of the invention to provide the transport wheel serving as the first conveying means in each conveying line with its own independent drive.

The link-belt conveyor 32 is used as the second conveying means for the two conveying lines 46, 47. So that both conveying lines 46, 47 can be operated with only a single link-belt conveyor 32, each link 50, 50', 50" of the link-belt conveyor 32 comprises one cell unit 51, 51' comprising four individual cells 52, 52', 52". The cells 52, 52', 52" are arranged next to each other in the direction of the conveying lines 46, 47, which, in the second section, extend in a straight line; each cell is intended to serve as a holder for one packaging container. The packaging containers are pushed into the cells 52, 52', 52" in the two set-down positions of each conveying line 46, 47. Of course, it also lies within the scope of the invention to provide each conveying line 46, 47 with its own independent conveyor to serve as the second conveying means.

In the exemplary embodiment shown here, there is also only one handling device 15 arranged between the two first sections of the two conveying lines 46, 47 and the two second sections of the two conveying lines 46, 47. So that both conveying lines 46, 47 can be operated with only one handling device 15, the rotary tables 35, 36, which are arranged on the linear slide 37 with an offset from each other in the direction of the second section of the first conveying line 46, are supplemented on the slide by two additional rotary tables 35', 36', also arranged with an offset in the direction of the second section of the second conveying line 47.

The rotational movement of the rotary table 35 is achieved by means of a coupling linkage, which rotates the table when the linear slide 37 is moved. For this purpose, one joint 43 of the connecting rod 41 is fixed to the machine stand 44, whereas the other joint 45 articulates the connecting rod 41 to the rotary table 35 via the connecting rod 42. In addition, the connecting rod 42 is rigidly connected to one of the four angle brackets 34 arranged on the rotary table 35. The rotary drive of the rotary table 36 adjacent to the rotary table 35 on the conveying line 46 is achieved by means of a connecting rod 49', which is articulated in the manner of a parallel shaft transmission to one of the angle brackets 34' on the rotary table 36' in the parallel conveying line 47 and to one of the angle brackets 34 on the rotary table 36.

The drive of the rotary table 36' is built as a mirror image of the drive of the rotary table 35: The rotational movement of the rotary table 36' is achieved in that a connecting linkage rotates the table when the linear slide 37 moves. For this purpose, one joint 43' of the connecting rod 41' is fixed to the machine stand 44, whereas the other joint 45' articulates the connecting rod 41' to the rotary table 36' by way of the connecting rod 42'. In addition, the connecting rod 42' is rigidly connected to one of the four holding brackets 34 arranged on the rotary table 36'. The rotary drive of the rotary table 35' adjacent on the conveying line 47 to the rotary table 36' is achieved by means of a connecting rod 49, which, in the manner of a parallel shaft transmission, is articulated to an angle bracket 34' on the rotary table 35' and to an angle bracket 34 on the rotary table 35 in the parallel conveying line 46.

Each rotary table 35, 35', 36, 36' comprises a square through-opening 48 in the center, which corresponds essentially to the square cross section of the packaging container to be transported. It can be seen that each opening 48 also comprises an additional rectangular recess 53 on one side.

The way in which the device described above works is explained below on the basis of FIGS. 1*a*-6*b*.

Because of the time it takes to fill the packaging containers in the second section of each conveying line is longer than the time it takes to produce the package bottom in the first section of each conveying line, two package bottoms are produced over the course of two timed steps of the transport wheel 5 of each conveying line 46, 47, during which two packaging containers are filled simultaneously in one timed step of the link-belt conveyor 32. Therefore, an idle interval of the link-belt conveyor 32 for the filling operation overlaps two idle intervals of the transport wheel 5 for the forming of the package bottom and the stripping of the packaging container 13 from the transport wheel 5. The handling device 15 compensates for the difference between the timing of the transport wheel 5 and the timing of the link-belt conveyor 32.

FIG. 1*a* shows the following situation: In a preceding cycle of the link-belt conveyor 32, the left cell 52 of the cell unit 51 was loaded with a packaging container 58. Toward the right in the conveying direction 55, packaging containers 57 are also present in the adjacent cell unit 56. In addition, one packaging container 54 is located in the handling device 15, namely, in the right holder 33; this is the container which, during the preceding step of the transport wheel 5, was stripped from the holding fixture 4, which is now in the left horizontal position, where it can accept the next package jacket 1. After the stripping operation during the preceding cycle of the transport wheel 5, the packaging container 54 received by the holder 33 is pushed by the linear slide 37 out of the unloading position into the position shown in FIG. 1*a*, as a result of which the right rotary tables 36, 36' are turned 90° clockwise by the coupling drive 41', 42', 49' (compare FIG. 1*c*).

It can be seen in FIG. 1*a* that the opening aids 2 are oriented in the conveying direction on the transport wheel 5. For technical reasons, the introduction and welding of the opening aid 2 into a package jacket 1 can be done only with this orientation. Because, after the packaging container is filled, the top of each container is welded as it passes through the line, each packaging container must be rotated 90° by the rotary tables 35, 35', 36, 36' before it is inserted into one of the cells 52, 52' of the link-belt conveyor 32, as a result of which the opening aids 2 become aligned transversely to the conveying direction.

Figure 2A:
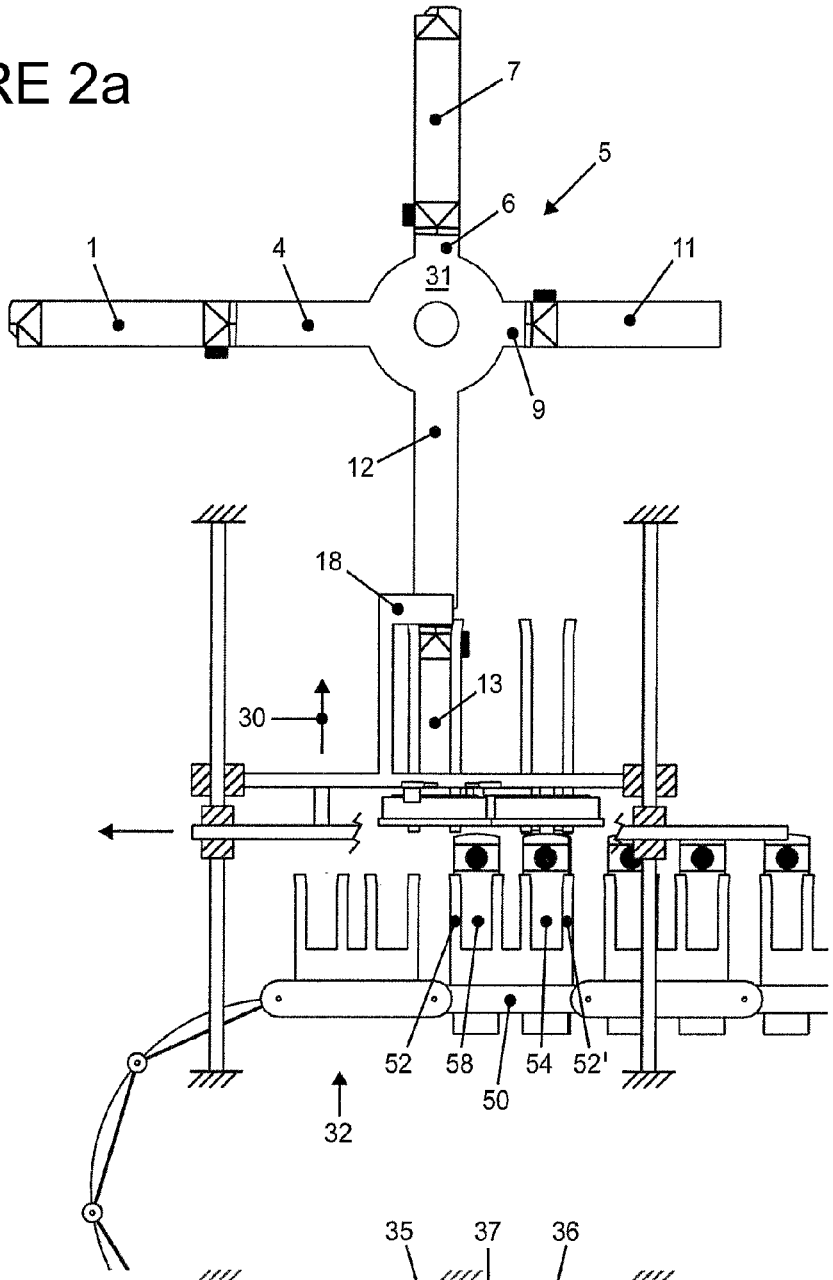
FIGS. 2*a* and 2*b* are an elevation view and a plan view as in FIGS. 1*a* and 1*b* in a second step of the method.

The next step shown in FIG. 2*a* now consists in that, simultaneously with the stripping-off of the packaging container 13 by the stripper 18 from the holding fixture 12 into the holder 14 located in the unloading position, the packaging container 54 is pushed by the right pusher element 19 out of the holder 33 into the cell 52' underneath, which is located in the right set-down position. It can be seen in FIG. 2*a* that now the cells 52, 52' on the chain link 50 are completely loaded with the packaging containers 58, 54. During this loading step, the package jacket 1 has also been pushed completely onto the empty holding fixture 4 of the transport wheel 5.

Figure 2B:
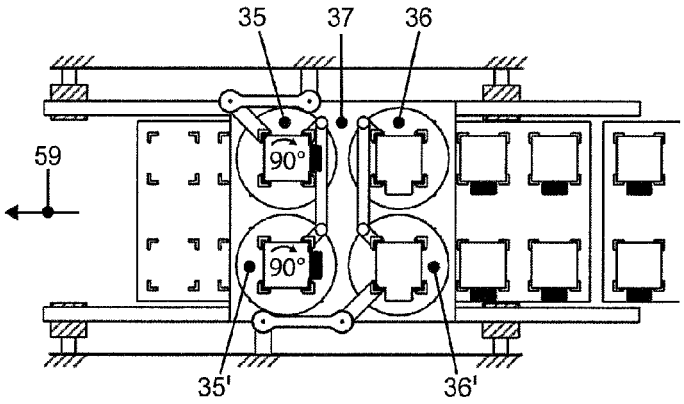

FIG. 2*b* shows that the rotary tables 35, 35' rotate 90° in the clockwise direction, and the rotary tables 36, 36' rotate 90° in the counterclockwise direction. Rotation begins as soon as the linear slide 37 is moved toward the left, i.e., in the direction of the arrow 59, into the position shown in FIG. 3*a*.

Figure 3A:
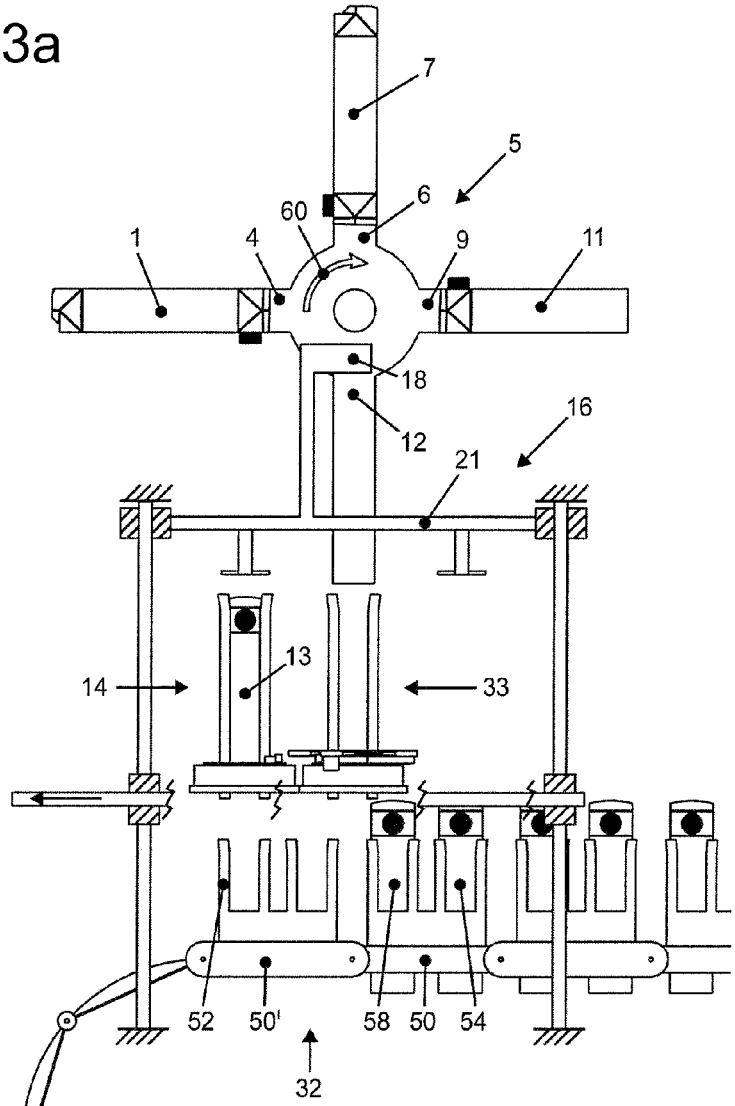
FIGS. 3*a* and 3*b* are an elevation view and a plan view as in FIGS. 1*a* and 1*b* in a third step of the method.

In FIG. 3*a*, the loaded link-belt conveyor 32 has not yet moved, because the process of filling the packaging containers is still going on in the filling machine. The transverse rod 21 of the positioning system 16 has been moved upward, in the direction of the arrow 30, from the lower position shown in FIG. 2*a* into the starting position shown in FIG. 3*a*, so that the transport wheel 5 with the holding fixture 9 can rotate by 90° into the lower position in the direction of the rotary arrow 60. After this rotation, the next packaging container 11 is located in the position shown in FIG. 4*a*, in which the holding fixture 9 is pointing downward, so that the container can then be stripped from the holding fixture 9.

Figure 3B:
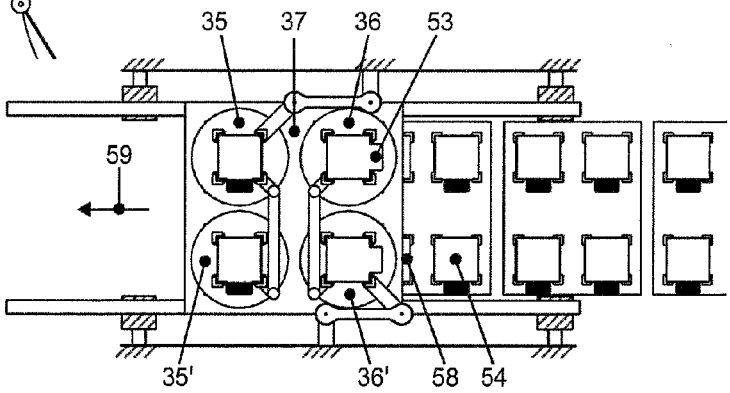
Figure 4A:
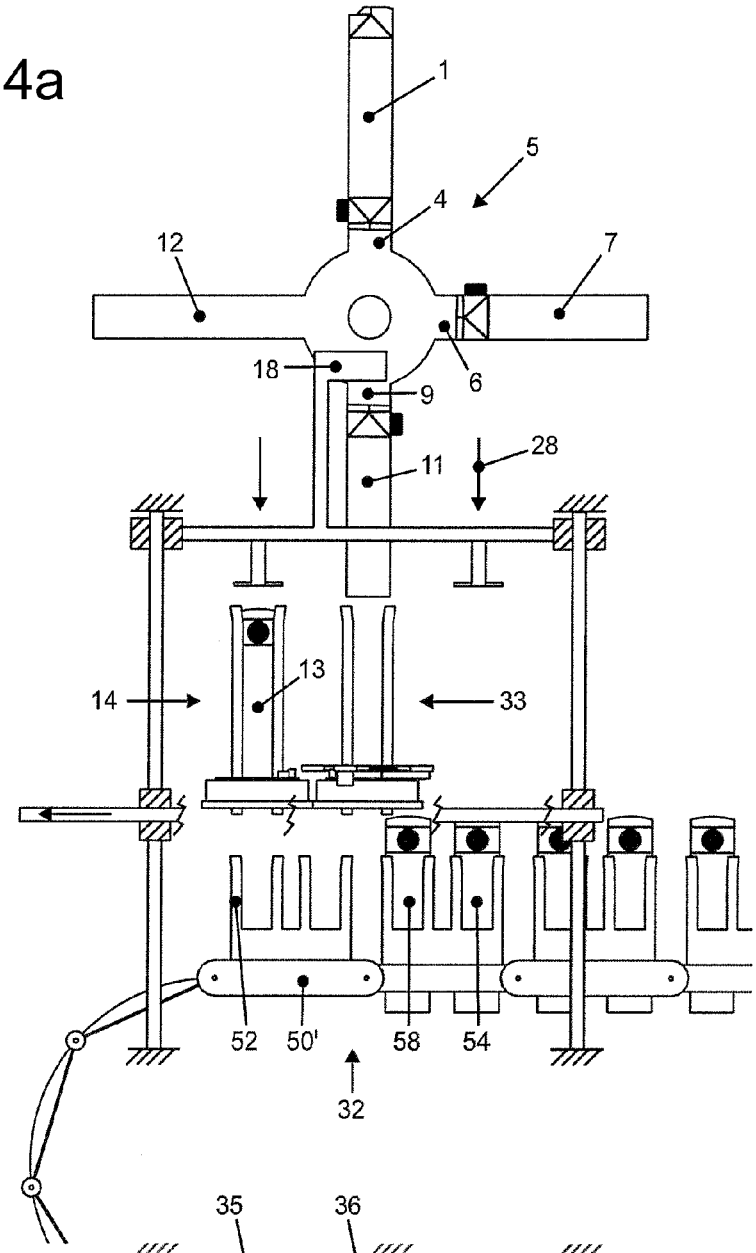
FIGS. 4*a* and 4*b* are an elevation view and a plan view as in FIGS. 1*a* and 1*b* in a fourth step of the method.
Figure 4B:
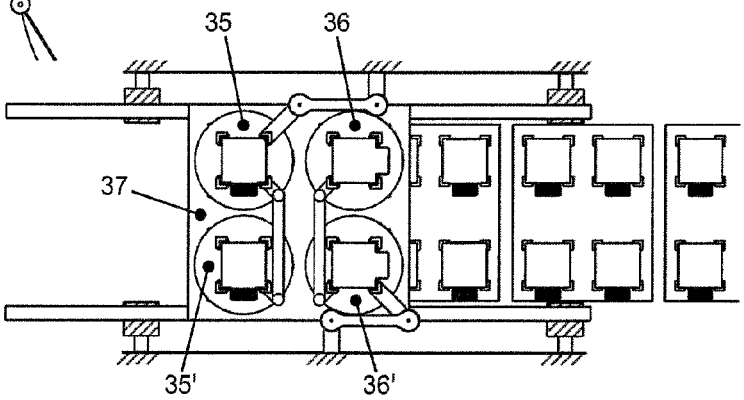

After that, the linear slide 37 is pushed from the right position shown in FIGS. 2*a* and 2*b* in the direction of the arrow 59 into the left position shown in FIGS. 3*a*, 3*b*. During this movement of the linear slide, the rotary tables 35, 35' and 36, 36' are turned 90° to the right and left, respectively, as can be seen in FIG. 3*b*.

Figure 5A:
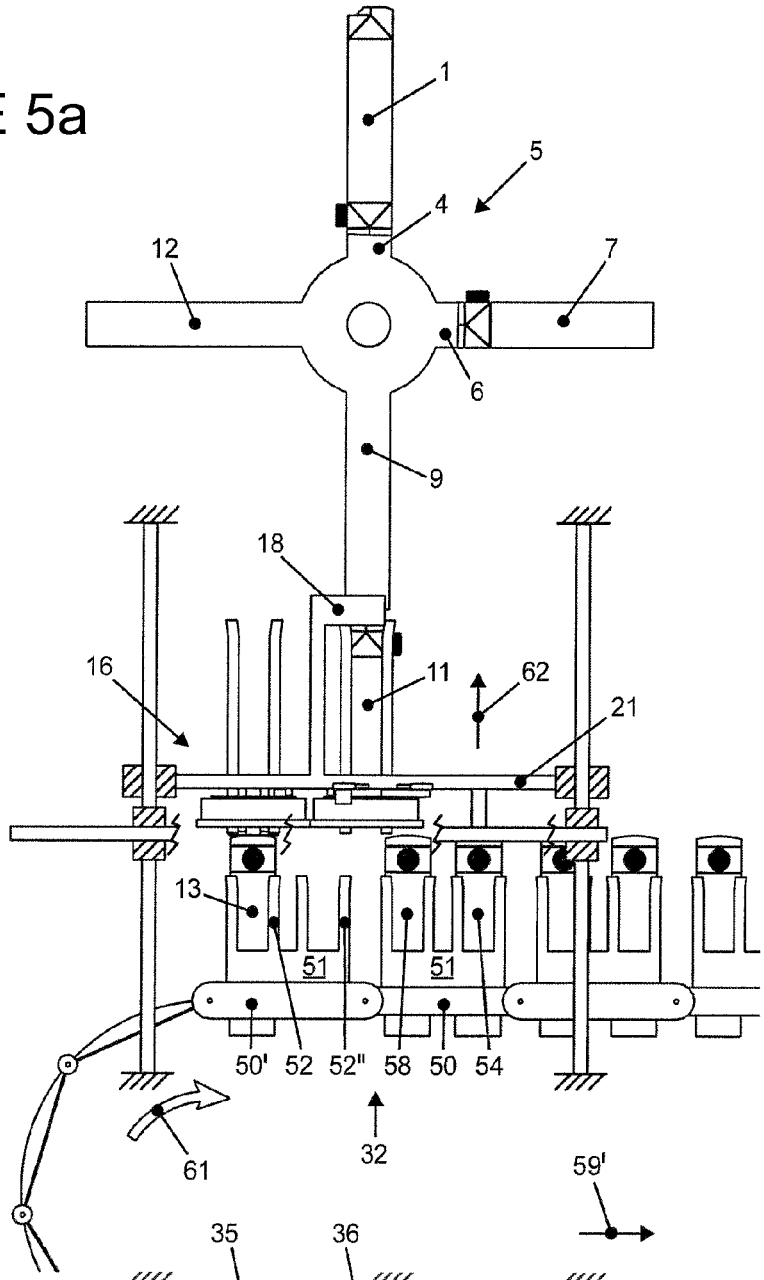
FIGS. 5*a* and 5*b* are an elevation view and a plan view as in FIGS. 1*a* and 1*b* in a fifth step of the method.
Figure 5B:
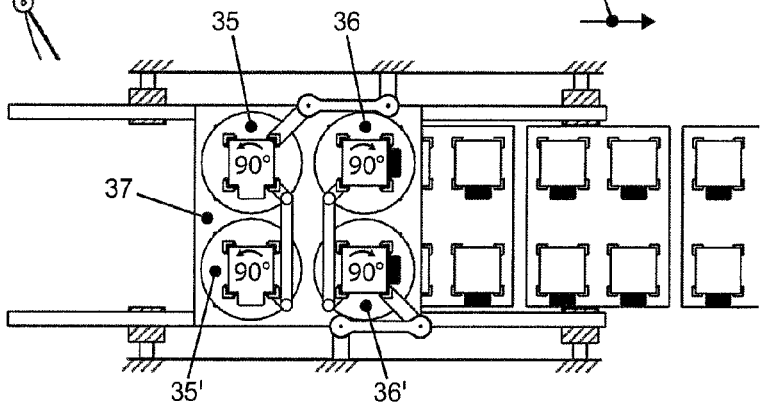
Figure 6A:
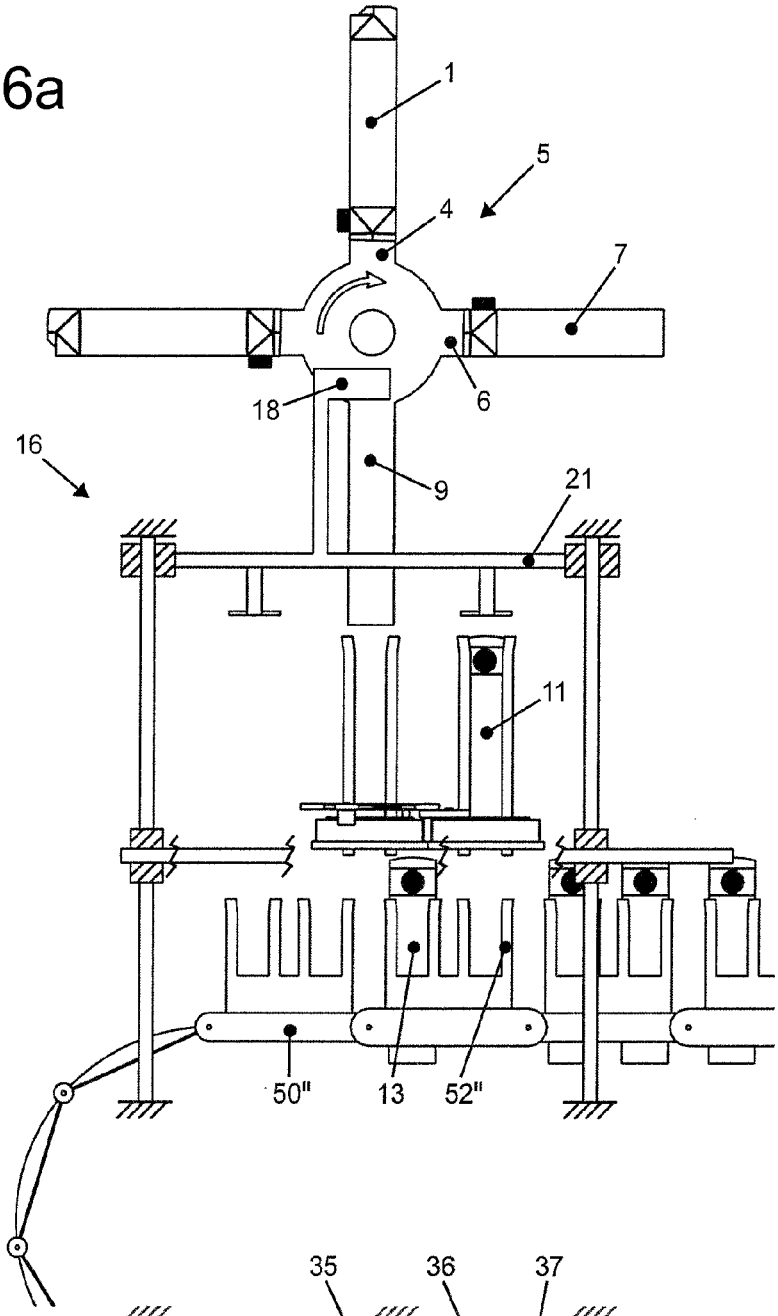
FIGS. 6*a* and 6*b* are an elevation view and a plan view as in FIGS. 1*a* and 1*b* in a sixth step of the method.
Figure 6B:
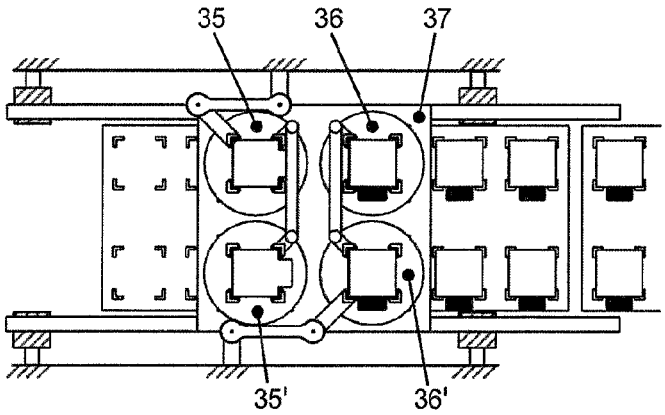

As a result of the movement of the linear slide 37, the left holder 14 is now above the left cell 52 of the left chain link 50', which is located in the left set-down position. The holder 14 has been rotated 90° in the clockwise direction. The transport wheel 5 is now rotated 90° in the clockwise direction as shown by the rotary arrow 60, so that the next package jacket 1 can be stripped from the holding fixture 9. This rotation of the transport wheel 5 has been completed in FIG. 4*a*. Now it is possible for the package container 11 to be stripped from the holding fixture 9 into the holder 33 and simultaneously for the packaging container 13 to be pushed out of the holder 14 into the cell 52 in the direction of the arrow 28. The completed vertical movement of the packaging containers 11, 13 is shown in FIG. 5*a*.

During the previously described loading of the cell units 51 with the two packaging containers 13, 54 per conveying line 46, 47, the filling operation has been carried out and completed. Now the link-belt conveyor 32 is moved onward by the length of one chain link 50', 50 during a conveying interval in the direction of the rotary arrow 61, and the transverse rod 21 of the positioning system 16 is moved out of the lower position in FIG. 5*a* in the direction of the arrow 62 back into the starting position shown in FIG. 6*a*, so that the cell 52" can now be loaded with the packaging container 11. After the transverse rod 21 has been moved into the starting position, the linear slide 37 is pushed out of the position shown on the left in FIG. 5*b* toward the right, in the direction of the arrow 59', into the position shown in FIG. 6*a*.

The transport wheel 5 rotates another 90° in the clockwise direction, as a result of which the holding fixture 6 arrives in a downward-pointing position above the unloading position for the packaging container 7. Thus the device is again in the starting position for timed, stepwise conveyance, as shown in FIGS. 1*a* and 1*b*.

At this point, one timed, stepwise movement of the link-belt conveyor 32 has occurred, wherein two packaging containers have been filled in each conveying line 46, 47 during the stationary interval of the step. During the idle interval of the link-belt conveyor 32, two packaging containers 13, 11 per conveying line 46, 47 have been unloaded from the transport wheel 5 by the handling device 15, and the link-belt conveyor 32 has been loaded with the two packaging containers 13, 11. As a result, during the operation of the device according to the invention, two idle intervals of the transport wheel 5, during each of which a packaging container 13, 11 is unloaded, overlaps with one idle interval of the link-belt conveyor 32.

List of Reference Numbers

| No. | Designation |
|---|---|
| 1 | package jacket |
| 2 | opening aid |
| 3 | arrow |
| 4 | first holding fixture |
| 5 | transport wheel |
| 6 | second holding fixture |
| 7 | package jacket |
| 8 | free end |
| 9 | third holding fixture |
| 10 | bottom |
| 11 | packaging container |
| 12 | fourth holding fixture |
| 13 | packaging container |
| 14 | first holder |
| 15 | handling device |
| 16 | positioning system |
| 17 | bottom |
| 18 | stripper |
| 19 | pusher element |
| 20 | pusher element |
| 21 | transverse rod |
| 22 | vertical rod |
| 23 | vertical rod |
| 24 | vertical rod |
| 25 | bushing |
| 26 | left vertical guide rod |
| 27 | right vertical guide rod |
| 28 | arrow |
| 29 | edge of package |
| 30 | arrow |
| 31 | center part of transport wheel |

-continued

List of Reference Numbers

| No. | Designation |
|---|---|
| 32 | link-belt conveyor |
| 33 | second holder |
| 34 | angle bracket |
| 35 | left rotary table |
| 36 | right rotary table |
| 37 | linear slide |
| 38 | guide rod |
| 39 | guide rod |
| 40 | bushing |
| 41 | connecting rod |
| 42 | connecting rod |
| 43 | joint |
| 44 | machine stand |
| 45 | joint |
| 46 | conveying line |
| 47 | conveying line |
| 48 | through-opening |
| 49 | connecting rod |
| 50 | chain links |
| 51 | cell unit |
| 52 | cell |
| 53 | recess |
| 54 | packaging container |
| 55 | conveying direction |
| 56 | cell unit |
| 57 | packaging container |
| 58 | packaging container |
| 59 | arrow |
| 60 | rotary arrow |
| 61 | rotary arrow |
| 62 | arrow |

The invention claimed is:

1. A method for the timed, stepwise conveyance of piece goods in a filling machine for liquid products along a conveying line with a first and a second section, comprising the steps of:

conveying the piece goods in the first section of the conveying line by a first conveyer and conveying the piece goods in the second section of the conveying line by a second conveyer;

operating the first conveyer in steps with a first timing, each of the steps of the first conveyer comprising an idle interval and a conveying interval;

operating the second conveyer in steps with a second timing different from the first timing, each of the steps of the second conveyer comprising an idle interval and a conveying interval, wherein each idle interval of the second timing overlaps in time at least two idle intervals of the first timing;

unloading one of the piece goods from the first conveyer during each idle interval of the first timing by a handling device arranged between the first and the second sections of the conveying line; and loading, by the handling device, the second conveyer during an idle interval of the second timing with all of the piece goods unloaded from the first conveyer during the idle interval of the second timing.

2. The method according to claim 1, wherein the loading of the second conveyer with the piece goods occurs at several set-down positions arranged with an offset from each other in the direction of the conveying line.

3. The method according to claim 2, wherein each one of the piece goods is unloaded from the first conveyer into an unloading position located between two of the set-down positions.

4. The method according to claim 3, wherein, after each piece has been unloaded from the first conveyer and before the each piece is loaded into the second conveyer, the each piece is transported from the unloading position to one of the set-down positions.

5. The method according to claim 1, wherein, after each piece has been unloaded from the first conveyer and before the each piece is loaded into the second conveyer, the each piece is rotated around a longitudinal axis of the each piece.

6. The method according to claim 4 wherein, after each piece has been unloaded from the first conveyer and before the each piece is loaded into the second conveyer, the each piece is rotated as it is being transported to one of the set-down positions.

7. The method according to claim 6, wherein the piece goods are conveyed by timed, stepwise movements in the filling machine along a plurality of parallel conveying lines, and the arrangement and timing of the first conveyer and the second conveyer and the arrangement of the handling mechanism are the same in all of the conveying lines.

8. A device for the timed, stepwise conveyance of piece goods in a filling machine for liquid products along at least one conveying line with a first section and a second section, comprising:

a first conveyer with a timed drive for conveying the piece goods in the first section of the at least one conveying line;

a second conveyer with a timed drive for conveying the piece goods in the second section of the at least one conveying line; and a handling mechanism arranged between the first section and the second section of the conveying line, said handling mechanism comprising means for unloading the piece goods from said first conveyer into a position a certain distance away from two set-down positions for the piece goods on said second conveyer, the set-down positions being arranged with an offset to each other in the direction of the conveying line, said handling mechanism further comprising means for transporting the piece goods from the unloading position to the set-down positions, and said handling mechanism further comprising means for loading said second conveyer with the piece goods at the set-down positions arranged with an offset from each other in the direction of the conveying line.

9. The device according to claim 8, wherein the unloading position is located between the two set-down positions arranged with an offset to each other in the direction of the conveying line.

10. The device according to claim 8, wherein said first conveyer comprises a transport wheel having several radially outward-projecting, parallel holding fixtures, each of said holding fixtures accommodating one of the piece goods.

11. The device according to claim 8, wherein said second conveyer comprises an endless link-belt conveyor with holders arranged next to each other in the direction of the conveying line, each of the holders accommodating one of the piece goods.

12. The device according to claim 8, wherein said first conveyer is operable in steps with a first timing, each of the steps of the first conveyer comprising an idle interval and a conveying interval, and said second conveyer is operable in steps with a second timing different from the first timing, each of the steps of the second conveyer comprising an idle interval and a conveying interval, wherein each idle interval of the second timing overlaps in time at least two idle intervals of the first timing.

13. The device according to claim 8, wherein said means for unloading comprises a stripper that is movable to rest against one of an edge and a surface of the piece good.

14. The device according to claim 8, wherein said means for loading comprises at least two pusher elements, each of said pusher elements is movable to rest against one of an edge and a surface of the piece good.

15. The device according to claim 8, wherein both said means for unloading and said means for loading are arranged on a single-axis positioning system.

16. The device according to claim 8, wherein said means for transporting comprises a linear slide movable from the unloading position to the set-down positions, on which slide at least two holders are arranged with an offset from each other in the direction of the conveying line for holding the piece goods.

17. The device according to claim 16, wherein said holders for holding the piece goods are supported rotatably on said linear slide.

18. The device according to claim 17, wherein said holders are connected to the stand of the handling mechanism by a coupling linkage, which causes the holders to rotate when the linear slide is moved.

19. The device according to claim 8, wherein the at least one conveying line comprises a plurality of parallel conveying lines, each with said first conveyor and said second conveyer, wherein the arrangement and timing of the first conveyer and said second conveyer and of each said handling mechanism in all of the conveying lines are the same.

20. A filling machine with at least one device for the timed, stepwise conveyance of piece goods according to claim 8.

* * * * *